US005577676A

United States Patent [19]

Berger et al.

[11] Patent Number: 5,577,676

[45] Date of Patent: Nov. 26, 1996

[54] METHOD AND APPARATUS FOR CONTROLLING THE TRAVERSING FREQUENCY IN A YARN WINDING SYSTEM

[75] Inventors: Hans-Peter Berger; Jorg Spahlinger, both of Wermelskirchen, Germany

[73] Assignee: Barmag AG, Remscheid, Germany

[21] Appl. No.: 326,018

[22] Filed: Oct. 19, 1994

[30] Foreign Application Priority Data

Oct. 19, 1993 [DE] Germany ..... 43 35 635.4

[51] Int. Cl.[6] ..... B65H 54/28; B65H 63/00; B65H 54/38

[52] U.S. Cl. ..... 242/18.1; 242/43 R

[58] Field of Search ..... 242/36 R, 18.1, 242/43 R, 43.1, 158 R

[56] References Cited

U.S. PATENT DOCUMENTS

| | | | |
|---|---|---|---|
| 3,751,893 | 8/1973 | Goodhue et al. | 242/36 X |
| 3,844,497 | 10/1974 | Harrill et al. | 242/36 |
| 3,861,607 | 1/1975 | Schippers et al. | 242/18.1 X |
| 4,202,506 | 5/1980 | Rohner | 242/36 |
| 4,504,024 | 3/1985 | Gerhartz . | |
| 4,685,629 | 8/1987 | Sugioka | 242/36 X |
| 4,697,753 | 10/1987 | Schippers et al. . | |
| 4,771,961 | 9/1988 | Sugioka | 242/18.1 |
| 4,805,844 | 2/1989 | Harmanns et al. | 242/36 X |
| 4,830,296 | 5/1989 | Ueda et al. | 242/36 X |
| 4,880,175 | 11/1989 | Yamauchi et al. | 242/36 X |
| 4,911,370 | 3/1990 | Schippers et al. | 242/18.1 |
| 5,022,596 | 6/1991 | Wey et al. | 242/36 |
| 5,074,481 | 12/1991 | Kathke | 242/36 |

OTHER PUBLICATIONS

*"Barmag Winder Program"*; Stand Sep. 1991; pp. 36–38.

*Primary Examiner*—Daniel P. Stodola
*Assistant Examiner*—Michael R. Mansen
*Attorney, Agent, or Firm*—Bell, Seltzer, Park & Gibson, P.A.

[57] ABSTRACT

A method and apparatus for controlling the traversing frequency during the winding of a cross-wound package. In so doing, a signal is detected which is generated by the motion of the yarn while being wound onto a yarn package. Thereafter, the signal is analyzed by frequency, and/or amplitude, or other characteristics. Finally, the traversing frequency of the yarn takeup system is adjusted or varied as a function of the analysis result. In the preferred embodiment, the signal is proportional to a development of airborne sound or a development of solid-borne sound, each of which is generated in response to the motion of the advancing yarn on the package being formed. The method of the present invention allows disturbances in the winding operation to be avoided, such as the formation of so-called ribbons and similar phenomena.

20 Claims, 2 Drawing Sheets

METHOD AND APPARATUS FOR CONTROLLING THE TRAVERSING FREQUENCY IN A YARN WINDING SYSTEM

BACKGROUND OF THE INVENTION

The present invention relates to a method and apparatus for controlling the traversing frequency in a yarn winding system, and in particular it relates to a method and apparatus for controlling the traversing frequency in a yarn winding system used in the production of yarn packages of synthetic fibers. More particularly, the invention relates to a method and apparatus for winding a yarn into a cross-wound package, and wherein the formation of undesirable ribbons is avoided.

When winding a yarn on a rotating tube, the yarn is constantly traversed along the length of the tube, so as to achieve a uniform distribution of the yarn on the tube, and to ensure a satisfactory strength of the yarn package being formed. The strength of the yarn package is of especially great importance for its transportation. The quality of traversing the yarn influences likewise the unwinding of the yarn package. In addition, the quality of the yarn package is rated by its wound structure.

During the winding, the traversing of the yarn is subjected to so-called laws of traverse. Basically, these laws of traverse distinguish between a random wind and a precision wind. In a random wind, the yarn is traversed substantially at a constant frequency, while it is being wound, which leads at a substantially constant speed of the advancing yarn to constant angles, at which the yarn is deposited on the package. In a precision wind, the frequency of the reciprocating movement (traverse) is tied to the speed of the package which slows down continuously during the winding process at a constant speed of the advancing yarn.

For many applications, the random wind is preferred because of the constant angle at which the yarn is deposited. However, the random wind has the disadvantage that so-called ribbons or patterns form during the winding operation. Ribbons will develop, when the ratio of the package speed to the traversing frequency results in an integer. Since the speed of the package decreases continuously during the winding process, such a condition may occur several times during the winding operation. As a result of the integral ratio of the frequencies, the yarn traversing mechanism deposits the yarn over several rotations of the package in the same location, i.e., over several rotations the advancing yarn comes to lie directly above the just previously wound yarn, and then slips off toward one side. This leads to a disorderly winding of the yarn, and is as such an undesired behavior.

Methods of winding a yarn to a cross-wound package are disclosed in U.S. Pat. Nos. 4,504,024 and 4,697,753. Both methods serve to avoid critical winding situations.

Critical winding situations include primarily those in which the spindle speed and the traversing frequency form an integral ratio or a ratio broken by a small integer. These situations are named pattern or "ribbon" formation. A so-called ribbon represents not only a major interference with the package buildup, but may also lead to an interruption of the winding process and to a destruction of the takeup machine by occurring imbalances.

It has shown that even in the case of a nonintegral wind ratio or wind ratios, which are not broken by a small integer (2, 3, 4 . . . ), ribbon situations or ribbon-like situations may still occur. These situations are in part process-dependent and unforeseeable. To avoid the ribbon formation in the first-mentioned case, the traversing motion is controlled in particular as a function of the wind ratios which occur during the winding of a cross-wound package. In this instance, they represent so-called "ribbon values", which announce their arrival by the ratio of spindle speed to traversing frequency. In the second case, it is a control of the traversing motion as a function of a predetermined traversing program.

In the simplest case, such a traversing program includes a predetermined traversing speed. Such a predetermined traversing speed may also be superposed by fluctuations (wobbling). In the method disclosed in U.S. Pat. No. 4,697,753, the traversing speed does not remain constant, but varies between an upper limit and a lower limit in accordance with a predetermined regularity, it being likewise possible that the upper limit and the lower limit change during the winding of a cross-wound package (winding cycle).

Described in BARMAG Publication No. 31 (9/1991), pp. 36–38, are several methods of avoiding ribbon formations. In a method described as ribbonfree random winding, the ribbons are skipped or jumped by switching the traversing frequency. Intermediate ribbons may be bypassed only by an additional wobbling. In a wobbling, the traversing frequency fluctuates about a mean traversing frequency.

In the described methods, the instant and the height of the jump are calculated from the ratio of speed to traversing frequency. Since the negative effects of a ribbon show not only at an exactly integral ratio, but also in a region outside the exactly integral ratio, the calculation of the time to jump requires that an adequate distance from the ribbon be assured. However, because of the continuously decreasing package speed and because of the fact that the builds of two packages are never identical, the calculated time of the jump frequently does not coincide with an optimal time of the jump.

It is therefore the object of the present invention to provide a method and apparatus for controlling the traversing frequency and possibly other parameters of the winding process, which allows undesired winding situations that are to be expected in the course of a winding process to be reliably avoided.

SUMMARY OF THE INVENTION

The above and other objects and advantages of the present invention are achieved by the provision of a yarn winding method and apparatus which include the steps of detecting a signal which is generated by the motion of the advancing yarn while it is being wound on the yarn package, analyzing the signal by frequency and/or amplitude, and adjusting the traversing frequency as a function of the result of the analysis.

The invention proceeds from the discovery that undesired winding situations, in particular ribbons, become noticeable by an unusual development of noise during the winding. Before reaching a ribbon, its approach is announced by an increase in the development of noise. The development of noise is maximal in the ribbon condition and decreases again after passing the ribbon. Likewise, intermediate ribbons lead to an increased development of noise. The development of noise may thus be considered as a measure for the momentary quality of the wind.

A sensor installed in each winding head allows the noise which develops during the winding to be detected, by loudness, frequency or frequency spectrum, center frequency, or other parameters characteristic of the noise development. This sensor is capable of detecting solid-borne or airborne sound. Measuring signals which announce or indicate critical winding situations, are correlated with current winding situations (package diameter), in that they are associated to a certain package speed and traversing frequency. It is likewise provided to detect the package speed and traversing frequency continuously.

When the law of traverse is made dependent on situations occurring in the course of the winding cycle, a critical noise signal is rated as such a situation, and the traversing speed is switched. When the law of traverse is pursued by a constantly preset program, it will be possible to change the program parameters on the one hand, so that this situation is prevented in the next winding cycle. Alternatively, it is possible to correct the desired values of the traversing speed which are preset by the program.

With special advantage, the invention may be used when applying the law of traverse of the so-called stepped precision. In so doing, the traversing speed follows on the average a predetermined course. However, the traversing speed is reduced in a plurality of steps, synchronously with the package speed, until it reaches a lower limit value, and it is then suddenly increased to an upper limit value. This causes different wind ratios (ratio of package speed to traversing frequency) to form suddenly. These wind ratios are previously calculated and stored in a memory of a control device. In accordance with the invention, it is possible to change the jump values on the basis of the noise development in the course of the winding cycle.

In one embodiment of the method in accordance with the invention for the control of the traversing frequency in a yarn winding system, a signal is initially detected, which correlates with the behavior of the yarn advancing onto a package based on its movement while being wound on the yarn package. The detected signal is then analyzed by frequency and amplitude, a frequency analysis being understood to be in particular the observing of a special frequency band. However, such a frequency band need not necessarily be relatively narrow, but may in particular be also very wide, such as develops, for example, from structural elements for detecting and processing, which exhibit a limited frequency response. In this instance, the frequency analysis is established by the frequency response of purposely selected structural elements. Thereafter, only the amplitude response of the detected signal is analyzed. Finally, the traversing frequency is adjusted as a function of the result of the analysis.

In a preferred embodiment, the response of the yarn to motion is detected by the development of airborne sound transmitted to the ambient air. The development of airborne sound is converted by an airborne sound transducer, in particular a microphone, into electrical signals. To this end, the microphone is arranged in the region of the takeup position, in which airborne sound mainly develops. This may be necessary, since other parts of the yarn winding system also generate airborne sound, and therefore could interfere with the detection. The detection of the airborne sound development is improved by the use of selected directional microphones, it being also possible to make a purposeful selection of the frequency band to be detected.

In another preferred embodiment, the response of the yarn to motion is detected by its development of solid-borne sound which propagates along the advancing yarn. The development of solid-borne sound corresponds to a periodical, longitudinal elongation of the yarn advancing under a tension. Such a periodical change in the elongation of the yarn can be detected by a yarn tension sensor. The yarn tension sensor supplies an electrical signal, which corresponds to the response of the advancing yarn to motion.

Alternatively, it is possible to detect, in lieu of the development of solid-borne sound along the advancing yarn, the development of solid-borne sound of the yarn package itself, of the tube carrying same, and of the associated bearing and support devices. Such a detection need not necessarily be made with an airborne sound microphone, but may proceed in suitable manner, for example, by means of vibration sensors arranged at specific points of the bearing and support devices.

Alternatively, it is possible to combine individually the three aforesaid possibilities of detection, or all three possibilities of detection may be combined with one another. This will be especially favorable, when all detection signals are superposed by a plurality of other interference signals, but allow to determine by correlating the detected signals a particular state of winding, such as that of a ribbon. In such an embodiment, a step of correlating the detected signals will precede the step of analyzing.

In a preferred embodiment of the method in accordance with the invention, a step of eliminating insignificant signal portions is performed after the step of detecting and before the step of analyzing or of correlating, if need be. Insignificant signal portions are in particular noise and response to motion, which are caused by the traversing motion. Preferably, the analyzing step occurs by filtering at least one frequency band out of the signal. Thereafter, the signal amplitude in each frequency band is determined. Preferably, the frequency band is only one, relatively wide band, which is predetermined by the frequency response of the structural elements used in the detection and analysis. A purposeful filtration of a frequency band is not needed in this instance.

In a preferred embodiment of the method in accordance with the invention, the traversing frequency is suddenly changed between substantially constant traversing frequencies. This means, that upon reaching, for example, a certain amplitude in a certain frequency band, a frequency jump of the traverse is released. The jump height may be predetermined in form of a table of the law of traverse. However, it may also be calculated from the given ratio of traversing frequency to package speed. Preferably, a change of the traversing frequency occurs only between predetermined, in particular two, traversing frequencies. When changing the traversing frequency, it is also possible to make the height and the direction of the jump dependent on changes which were made in the past of this winding process. In a specially preferred embodiment, the jump of the traversing frequency is selected so that at least immediately after the instant of the jump of the traversing frequency, no unfavorable ratio of package speed to traversing frequency is assumed. In a further preferred embodiment, a traversing stroke, i.e., the extent of the reciprocating movement of the yarn during the winding, is changed likewise as a function of the analysis result. Thus, after performing a jump of the traversing frequency, it is possible to change the traversing stroke at the same time, so as to adapt same to the new conditions of the winding process. Such a measure can have a favorable influence on the overall winding quality of the yarn package.

BRIEF DESCRIPTION OF THE DRAWINGS

Further advantages, characteristics, and uses of the present invention will become apparent from the following description of embodiments with reference to the drawings, in which.

DETAILED DESCRIPTION OF THE PREFERRED EMBODIMENTS

Figure 1:
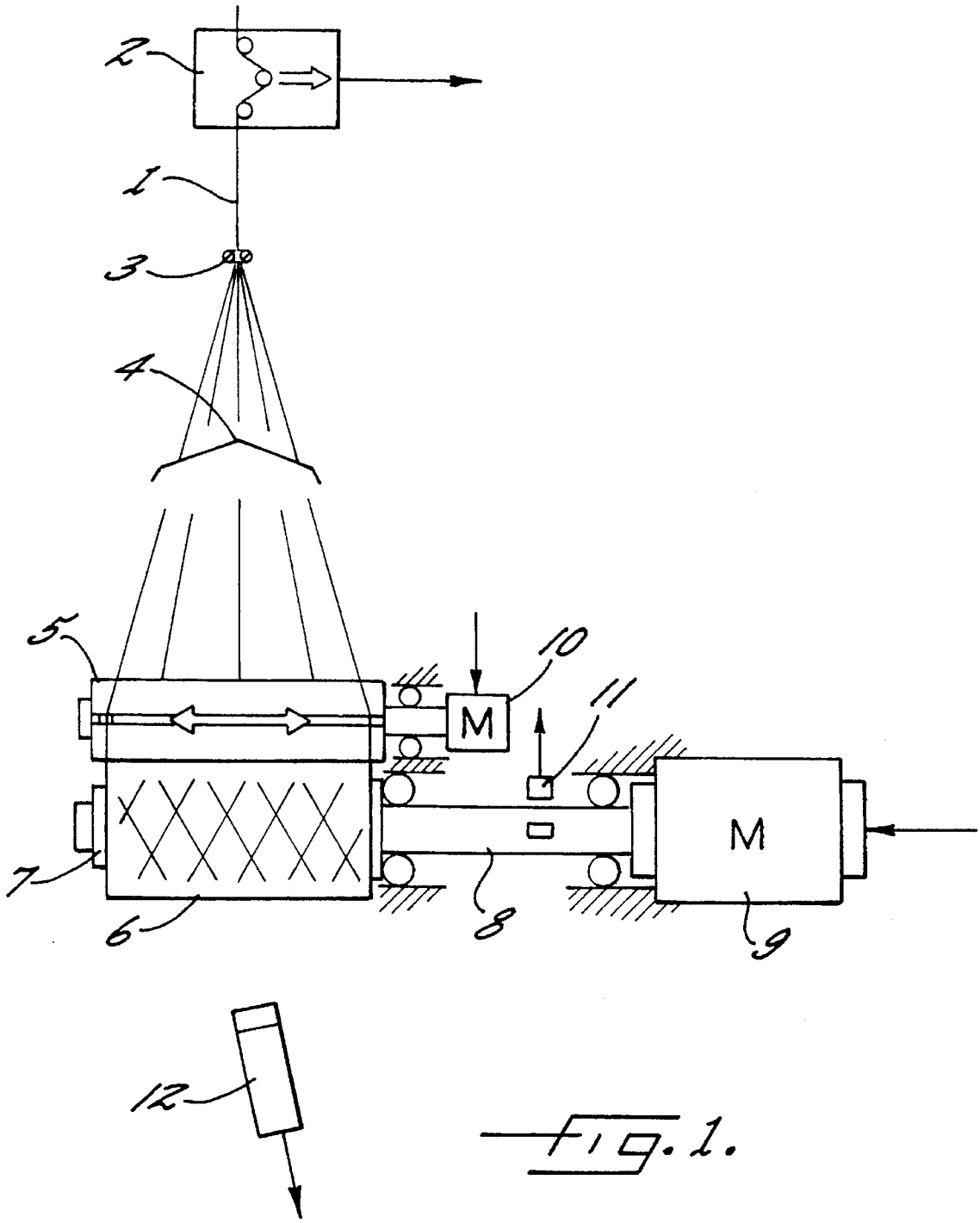
FIG. 1 is a schematic illustration of a typical arrangements. of a yarn winding system which embodies the preset invention.

Shown in FIG. 1 is a diagram of a yarn winding system, which allows the method of the present invention to be carried out. A yarn 1 advances through an apex yarn guide 3, via a traversing triangle, onto a package 6. The traversing motion (by which traversing triangle 4 is formed), is effected by a yarn traversing mechanism 5. As a result of the traversing motion, cross-shaped patterns are produced on yarn package 6. Prior to its entry into apex yarn guide 3, the yarn passes through a yarn tension sensor 2. The yarn tension sensor 2 emits a signal, which corresponds to the yarn tension at the position of the sensor.

The yarn package 6 is carried in its interior by a tube 7. The tube 7 is driven via a spindle 8 by a spindle drive motor 9. The spindle drive motor 9 is subjected to a control, which causes the spindle speed to decrease continuously during the winding process as the diameter of the package increases, so that the speed of the advancing yarn remains constant. As an alternative to the spindle drive of tube 7, it is also possible to drive package 6 by friction. In this instance, the motor of the friction drive is operated substantially at a constant speed. The spindle 8 is scanned by a motion sensor 11, with the latter detecting the vibrations of spindle 8, which may be caused by an unusual winding condition (in particular ribbons).

The yarn traversing mechanism 5 is driven by a motor 10. The drive motor 10 is controlled by a driver circuit, which is described in more detail below.

In the vicinity of the point at which yarn 1 advances onto package 6 at a tangent, a microphone 12 is arranged. Microphone 12 has a directional characteristic which permits the signals proceeding from yarn package 6 to be detected with an increased sensitivity. In this manner, it is also possible to suppress other surrounding undesired noises relative to the sound development of the winding process.

When performing a random wind, the drive motor 10 of yarn traversing mechanism 5 operates substantially at a constant speed. Simultaneously, the spindle drive motor 9 for yarn package 6 decelerates continuously, so that yarn 1 is wound at constant speed of advance. The decrease in speed of spindle drive motor 9 follows substantially a hyperbolic curve over the time of the winding process. This continuous decrease of the spindle speed by motor 9, allows to obtain integral ratios of traversing speed to spindle speed several times in the course of the winding process. This means that the one variable is an integral multiple of the other. This condition is referred to as ribbon. Intermediate ribbons are nonintegral ratios of the traversing frequency to the spindle speed. However, their ratio may be expressed in small integers, such as, for example, two to three, three to five, four to seven, etc. Both ribbons and intermediate ribbons are undesired in the winding process, since they impair the quality of package 6. Even before such a situation occurs during the winding process, same announces itself, as the spindle speed decreases, by an increased response of advancing yarn 1 to motion. This is due to the fact that the yarn traversing mechanism attempts to almost exactly superpose yarn 1. The yarn slips off toward the side and thereby generates a development of sound, which propagates as airborne sound in the ambient air, and advances as a solid-borne sound along the yarn. Likewise, the periodic slipping of yarn 1 causes a vibration of package 6 itself as well as of tube 7 carrying package 6, and finally of drive spindle 8. These vibrations are also transmitted to the bearings of drive spindle 8 and to motor 9. The airborne sound signals are detected by microphone 12, the solid-borne sound signals advancing along yarn 1 are detected by yarn tension sensor 2, and the vibrations of package 6 are picked up by a motion sensor 11 arranged on spindle 8.

Figure 2:
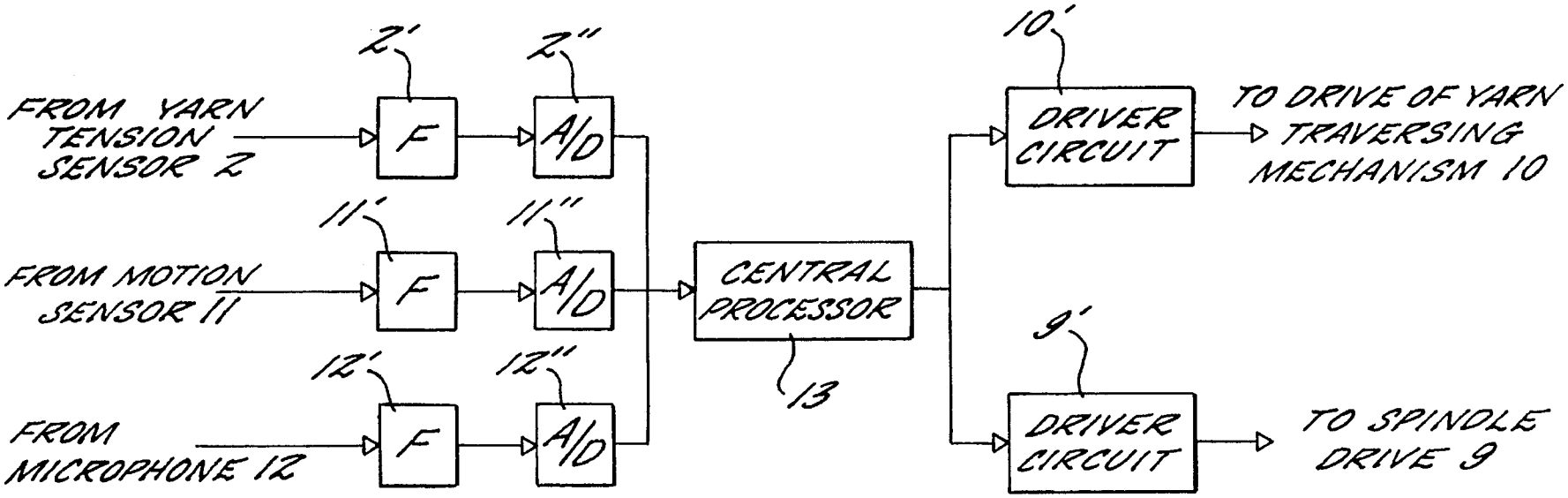
FIG. 2 is a block diagram of a control of the yarn winding system.

FIG. 2 illustrates a block diagram for a control of the yarn takeup system. In a central data processing device 13, the signals from yarn tension sensor 2, motion sensor 11, and microphone 12 are processed. To this end, the individual signals are subjected, each to a filter 2', 11', and 12', and to a subsequent analog-digital conversion 2", 11", and 12". Accordingly, the respectively detected signals are supplied in digital form to data processing device 13. The latter is further supplied with data about the momentary traversing frequency and the spindle speed of motor 9.

In the data processing device 13, the filtered and digitized signals from tension sensor 2, motion sensor 11, and microphone 12 are processed. To this end, it is possible to perform a further digital signal processing. In particular, however, the signals are correlated with one another, so as to determine the arrival of a ribbon when the signals are found to be homogeneous. A correlation of the individual signals is however not necessary in accordance with the invention. Rather, the detection of one signal out of the three available signals will already suffice to determine the ribbon formation with the inclusion of the known traversing frequency and the known, momentary spindle speed. However, a correlation of the individual signals may increase the reliability of indication.

The data processing device 13 controls, via a driver circuit 9', spindle drive motor 9, so that the yarn takeup speed remains substantially constant. The data processing device 13 controls further, via a driver circuit 10', the drive motor 10 of the yarn traversing mechanism. Typically, the speed of drive motor 10 is maintained constant in stages. When the spindle speed of drive motor 9 approaches a ribbon, the increased response of yarn 1 to motion is detected by one or several of the aforesaid sensors, and the data processing device 13 is caused to select a different speed for drive motor 10. In so doing, the data processing device 13 considers the momentary spindle speed, and makes sure that the jump to a different traversing frequency does not extend to another ribbon or intermediate ribbon. The then assumed traversing frequency will either be maintained, or be returned to the original frequency after establishing a certain "safety distance." Alternatively however, it may be provided to maintain the new traversing frequency, until a new ribbon announces its arrival. The direction and height of the jump, i.e., the frequency interval for a new traversing frequency, are established by the data processing device 13, in particular in consideration of the spindle speed. It is also possible to previously store certain jump patterns in a memory.

The use of the method of this invention allows to ensure that the negative effects of the ribbons are eliminated in the winding of a yarn, since a poor winding behavior can be identified by its development of noise. The instant of a jump in the traversing frequency may thus be exactly determined during operation. The method of this invention further allows to bypass with certainty concentrated intermediate ribbons without a wobbling of the traversing frequency.

That which is claimed:

1. In a method of winding an advancing textile yarn into a core supported package in which the yarn is wound about a rotating core at a substantially constant rate while the yarn is guided onto the rotating core by a traversing yarn guide which defines a traversing frequency, the improvement therein comprising the steps of:

detecting a signal which has a frequency and an amplitude and which is generated by the motion of the advancing yarn while it is being wound on the yarn package, analyzing at least one of the frequency and the amplitude of the signal, and adjusting the traversing frequency as a function of the result of the analysis and while maintaining the winding speed of the yarn on the package substantially constant.

2. The method as defined in claim 1 wherein the detected signal is airborne sound, which is transmitted to the surrounding air by the motion of the advancing yarn.

3. The method as defined in claim 2 wherein the detecting step includes converting the detected signal into electrical signals by an airborne sound transducer, which is positioned in the region of the package being wound.

4. The method as defined in claim 1 wherein the detected signal is solid borne sound which is propagated through the advancing yarn.

5. The method as defined in claim 4 wherein the detecting step includes detecting the signal by means of a yarn tension sensor.

6. The method as defined in claim 1 wherein the detected signal is solid borne sound which is propagated through the package being formed.

7. The method as defined in claim 1 wherein the analyzing step further includes the step of eliminating insignificant portions of the detected signal which are generated by the traverse motion of the yarn.

8. The method as defined in claim 1 wherein the analyzing step includes filtering at least one frequency band from the signal and determining the signal amplitude in each frequency band.

9. The method as defined in claim 1 wherein the adjusting step includes suddenly changing the traversing frequency between substantially constant traversing frequencies.

10. The method as defined in claim 9 wherein the traversing frequency is changed between predetermined traversing frequencies.

11. The method as defined in claim 9 wherein the change of the traversing frequency is selected such that at least immediately after the time of frequency change an unfavorable ratio of package speed to traversing frequency is avoided.

12. The method as defined in claim 1 wherein the detecting step includes detecting at least two signals which are generated by the motion of the advancing yarn, with the two signals being selected from the group consisting of airborne sound, solid borne sound propagated through the advancing yarn, and solid borne sound propagated through the package being formed.

13. In a method of winding textile yarns into core supported packages including the steps of winding yarn about a core at a substantially constant rate and guiding the yarn onto the core by a traversing yarn guide which defines a traversing frequency, the improvement therein comprising the steps of:

providing a controllable program for the traverse of the traversing yarn guide, with the program for the traverse including detecting a noise signal generated by motion of the advancing yarn being wound on the package, and controlling the traversing frequency as a function of the noise signal generated by the winding of the package, and controlling the traverse of the traversing yarn guide according to the controllable program.

14. The method as defined in claim 13 wherein the program for the traverse includes a controlling the traversing motion upon exceeding a predetermined limit value of the noise generated by the motion of the advancing yarn while it is being wound on the package.

15. The method as defined in claim 13 wherein the program for the traverse comprises pre-set, variable program values, and wherein the program includes changing the preset program values as a function of the detected noise signal generated by the motion of the advancing yarn while it is being wound on the package.

16. The method as defined in claim 13 wherein the program for the traverse includes a stepped precision function, with the traversing frequency being continuously decreased, along with the package speed, between two limit values in each step, starting from an upper limit value, and upon reaching a predetermined lower limit value, suddenly increasing to an upper limit value which has been changed as a function of noise generated by the motion of the advancing yarn while it is being wound on the package.

17. In an apparatus for winding textile yarns into core supported packages including means for rotating the core to wind the yarn therearound at a substantially constant rate, yarn guide means movable axially along the core for guiding yarn onto the core, and means for traversing said yarn guide means so as to define a traversing frequency, the improvement therein comprising means for detecting a signal which has a frequency and an amplitude and which is generated by the motion of the advancing yarn while it is being wound on the yarn package, means for analyzing at least one of the frequency and amplitude of the signal, and means for adjusting the traversing frequency as a function of the result of the analysis and for maintaining the winding speed of the yarn on the package substantially constant.

18. The apparatus as defined in claim 17 wherein said signal detecting means comprises a microphone for detecting sound.

19. The apparatus as defined in claim 17 wherein said signal detecting means comprises a tensionometer for monitoring the tension of the advancing yarn.

20. The apparatus as defined in claim 17 wherein the signal detecting means comprises sensor means for detecting the vibration of the package being wound.

* * * * *